US007575222B2

(12) United States Patent
Hamilton

(10) Patent No.: US 7,575,222 B2
(45) Date of Patent: Aug. 18, 2009

(54) DRAWWORKS FOR DRILLING RIGS

(76) Inventor: Michael D. Hamilton, 5701 Devlin Pl., Midland, TX (US) 79707

( * ) Notice: Subject to any disclaimer, the term of this patent is extended or adjusted under 35 U.S.C. 154(b) by 0 days.

(21) Appl. No.: 11/454,425

(22) Filed: Jun. 16, 2006

(65) Prior Publication Data

US 2008/0006805 A1 Jan. 10, 2008

Related U.S. Application Data

(60) Provisional application No. 60/692,052, filed on Jun. 17, 2005.

(51) Int. Cl.
*B66D 1/14* (2006.01)

(52) U.S. Cl. ..... 254/342; 254/358; 254/365

(58) Field of Classification Search ..... 254/342, 254/355, 358, 365, 378, 379
See application file for complete search history.

(56) References Cited

U.S. PATENT DOCUMENTS 1,688,599 A * 10/1928 Sage et al. ..... 254/358
3,101,828 A * 8/1963 Wilson ..... 192/139
3,964,692 A * 6/1976 Pendleton ..... 254/379
4,552,340 A * 11/1985 Sheppard ..... 254/358
4,588,167 A * 5/1986 Finzel ..... 254/346
4,751,969 A * 6/1988 Klaeger ..... 166/369
5,425,435 A * 6/1995 Gregory ..... 188/77 W
5,609,229 A * 3/1997 Sell ..... 188/77 R
5,671,912 A * 9/1997 Langford et al. ..... 254/267

* cited by examiner

*Primary Examiner*—Emmanuel M Marcelo
(74) *Attorney, Agent, or Firm*—Marcus L. Bates

(57) ABSTRACT

A drawworks for drilling rigs having an improved dual brake system that divides the drill line load equally between the dual brakes, a more efficient braking action is realized by the provision of radial guide rollers positioned to urge the brake bands into concentric relation respective the brake drums which maximizes contact therebetween and results in more sensitive control of weight on bit. A chain and sprocket drive line includes flingers immersed in lub oil which effectively distributes lub oil throughout the drive line.

6 Claims, 9 Drawing Sheets

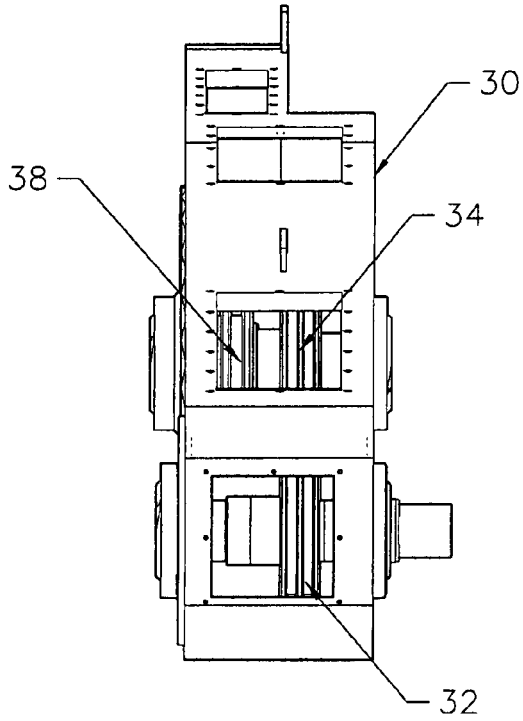
Fig. 13
Fig. 14
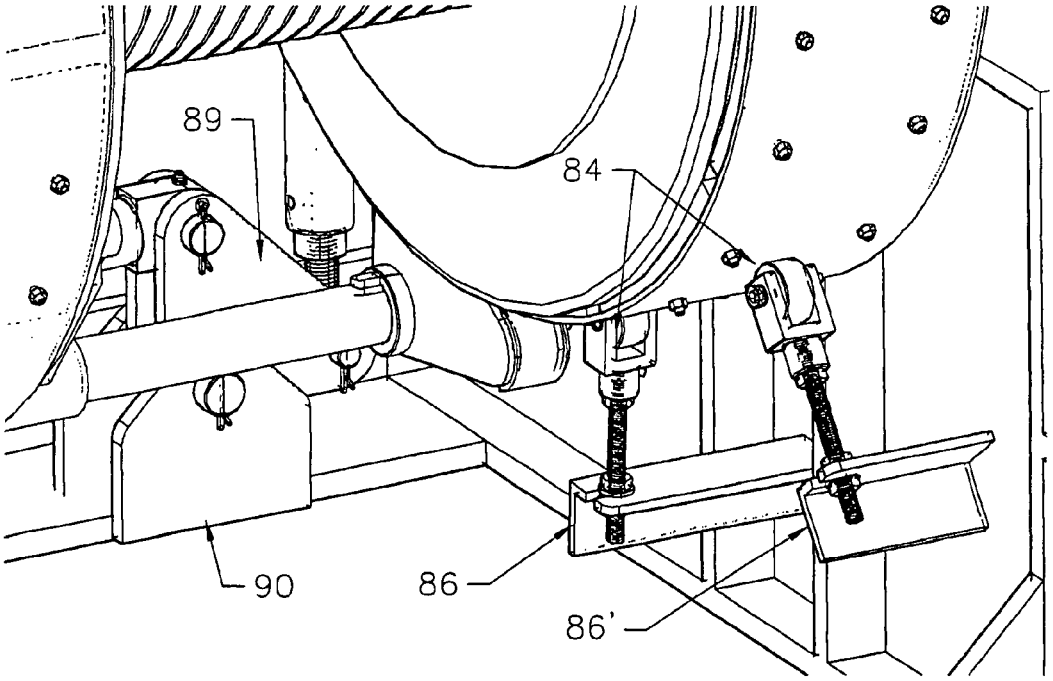

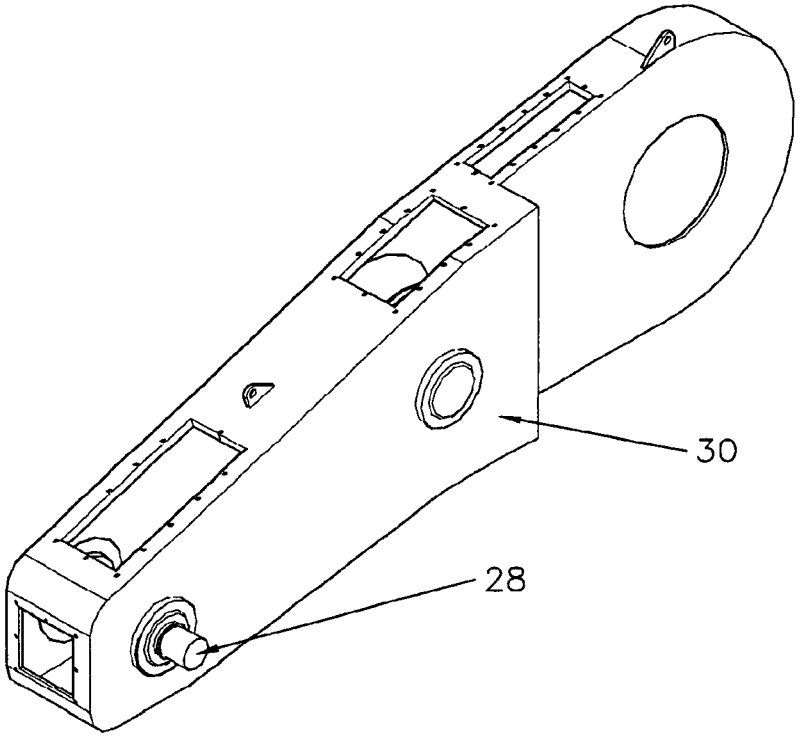
Fig. 15
Fig. 16
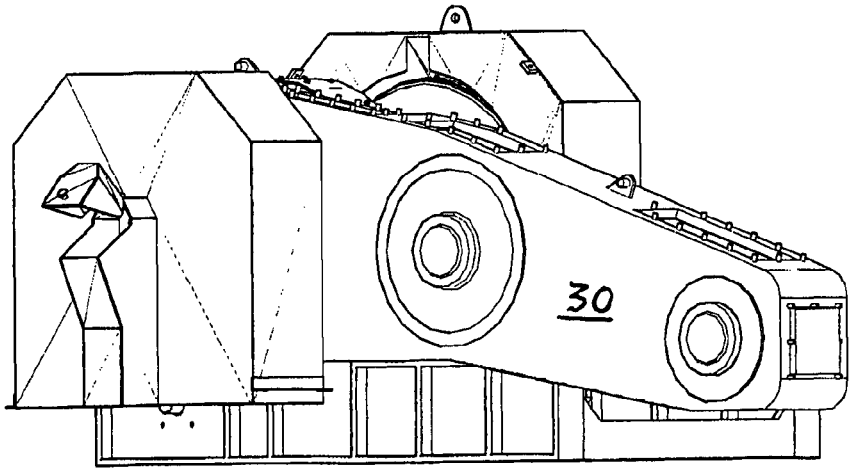

DRAWWORKS FOR DRILLING RIGS

CROSS-REFERENCE TO RELATED APPLICATIONS

PROVISIONAL PATENT APPLICATION: SER. NO. 60/692,052 FILED JUN. 17, 2005

STATEMENT REGARDING FEDERALLY SPONSORED RESEARCH OR DEVELOPMENT

NOT APPLICABLE

REFERENCE TO A MICROFICHE APPENDIX

NOT APPLICABLE

BACKGROUND OF THE INVENTION

This disclosure sets forth the details of an improved drawworks intended for drilling rigs, as well as for use in other fields where the use of similar apparatus is deemed desirable. A critical component of most drilling rigs is the drawworks. In the absence of a rugged, reliable drawworks, a drilling rig cannot function safely and efficiently; and can therefore become a liability. In the past, innumerable different drawworks have been proposed and manufactured as evidenced by the abundance of patents issued in Class 242 and 254 of the U.S. Patent Office. There are other classes and subclasses related to various aspects of a drawworks to be found in the U.S. Patent Office.

The drawworks is a necessary component, or sub-combination, of most all conventional drilling rigs. Therefore, a brief review of some of the more common features and functions associated with drilling rigs should provide a greater appreciation of the problems that the present invention overcome. These common features associated with a drilling rig include the following components, or sub-combinations;

(a) a rugged tower;

(b) a crown block affixed near the top of the tower;

(c) a traveling block suspended below the crown block by cables roved therebetween, thus enabling the traveling block to move vertically within the rig tower;

(d) a drawworks as described herein having a cable drum connected to pay out and retrieve cable to hoist and lower the travelling block, and to provide other useful and necessary functions as might be required on the drilling rig;

(e) a hook or other means on the traveling block to support and vertically manipulate a drill string comprised of lengths of drill pipe, production pipe, or the entire drill string;

(f) a rotary table connected to a prime mover by a gear train and arranged to rotate a kelly connected to the top of the drill string;

(g) a swivel and mud line is connected to the Kelly of the drill string to facilitate circulation of drilling fluids that remove cuttings, with the Kelly being slidably received by the rotary table while supporting the entire drill string at a selected number of revolutions per minute to thereby enable a drilling operation to be carried out.

The drill string is supported by the swivel at a controlled variable elevation to reduce the weight on the bit to a desirable value. While making hole, each time the bit has advanced a full length of the Kelly, the drill string is lifted by the drawworks until the kelly is out of the rotary table. The topmost length of the string of pipe is suspended by slips placed in the rotary table and the Kelly is disconnected so that a new length of pipe can be added below the Kelly, which then is reconnected, and the bit is returned to the bottom of the hole to resume drilling.

When a new bit is required, or other operational change becomes necessary, all the drill pipe must be tripped out of the hole by the drawworks. In this operation the procedure is to lift and disconnect the kelly and put it to one side in a "rat hole". The travelling block is fastened to the top of the drill string by means of elevators suspended from the traveling block and the drill string is then raised out of the hole, whereupon, one stand, or three lengths of drill pipe at a time, are removed from the string and placed in a rack on a monkey board in the tower of the rig. When the new bit has been installed, the string is tripped back into the hole using the traveling block to lower the string and fasten each stand in order. Then the kelly is replaced and the rotary table is restarted to commence drilling.

THE PRIOR ART DRAWWORKS

A major problem associated with drawworks of the Prior Art is the inability to provide a long, reliable, useful life. One reason for this unreliability is that the main frame of the drawworks often is of inadequate structural integrity to withstand the complex forces applied thereto during a drilling operation; hence, undue bending or torsional forces accelerate wear of the vital components which eventually can lead to catastrophic failure unless timely corrected; as for example, when malfunction of a component causes sudden stoppage of the drawworks to an extent that results in the parting of the drill line, whereupon, the drill string is dropped and falls downhole.

In such an instance, it is possible for a drawworks failure to topple the tower and destroy a drilling rig valued at millions of dollars, as well as endangering the lives of all the workers.

Some components of the prior art drawworks are inaccessible and therefore difficult to regularly inspect or service. Accordingly, the vital parts cannot always be properly maintained when an impending failure is overlooked. It is therefore desirable to provide a drawworks having components which are readily accessible for inspection, and, more importantly, easily field replaceable or repaired in minimum time and effort, which thereby promotes safety as well as avoiding loss of life and property. The present invention achieves these desirable features of a drawworks.

The life of a drawworks also relies upon proper lubrication of the moving parts, therefore, this disclosure provides an improved and novel lubrication system that assures the components thereof are properly and timely lubricated.

Another desirable feature of the drawworks of this disclosure is the provision of an improved dual brake system that provides positive arresting of the drill line and positive control of the weight on bit in a superior manner respective prior art drawworks. The novel brake system of this disclosure further includes novel adjustable features that equalizes the braking force between the two separate spaced apart brake drum assemblies associated with the cable drum of this drawworks. The present novel drawworks further includes an auxiliary brake system that is selectively engaged for running heavy loads into and out of the wellbore.

Accordingly, the drawworks of this disclosure actually provides the Driller with three cable drum brakes.

These and other objects of this invention will become evident as the instant disclosure is more fully digested by those skilled in the art.

The present invention therefore encompasses an improved drawworks having desirable features that overcome many problems found with the prior art drawworks. This disclosure comprehends a new, improved and novel drawworks having additional unobvious features that overcome many of the disadvantages of prior art drawworks. As previously noted, a major problem found in drawworks of the prior art is the inability to provide a long, reliable, useful life and it has been found that the reason for this reduced life span is that the main frame is inadequate to withstand the complex forces applied thereto and accordingly subjects the various components thereof to undue torsional forces that promote misalignment and undue wear of the expensive bearings and other critical parts and thereby accelerates wear which eventually leads to failure.

Lifting great weights now and then is no big problem to those skilled in the art. However, supporting and lifting great weights becomes a serious problem when the weight is a drill string which must be continually incrementally lowered and hoisted while supported by the lifting apparatus, herein referred to as a drawworks. This is especially so when the load is continuously readjusted 24 hours a day for weeks at a time, whereupon the problem assumes much greater proportions; particularly where the lifting apparatus must be reliable for years. This seemingly insurmountable problem is further compounded when the life and limb of many workers depend upon the reliability and proper operation of the lifting devices. Stated differently, it is desirable that a drawworks always and instantly responds to the Driller's commands exactly as instructed.

Those associated with drilling rigs readily appreciate a drawworks that has developed a history of reliability thereby becoming one of the most important sub-combinations of the drilling rig. This is readily apparent upon the realization that an expensive work crew and a multi-million dollar drilling rig becomes useless when the drawworks fails to operate properly. Many people associated with the oil patch have simply overlooked the important roll that the drawworks plays in the oil and gas industry.

Accordingly, a good drawworks is expected to carry a super heavy load while making endless trips into and out of the borehole in a minimum of time. It is desirable that a drawworks should never malfunction or breakdown. The simple action of retrieving and paying out the drilling line cable becomes very complex when the various automated accessories are added thereto for the gigantic load it carries must be raised and lowered in a minimum of time, while at the same time be capable of operating at exceedingly slow speed in order to maintain a constant and exact weight on bit.

Therefore, the design and fabrication of a drawworks that meet all of the demands of a modern drilling rig is a very important task. The purpose of this disclosure is the provision of an improved drawworks that achieves the above desirable attributes as well as adding safety and comfort in guarding the lives of the roughnecks that must depend upon the apparatus around the clock for many days at a time.

The Inventor of the drawworks disclosed herein is a former rig mechanic and during his former years he has acquired a great appreciation of the most important features that constitute a good drawworks, as well as the necessary design features that in the past have caused many of the avoidable problems associated with a drawworks. Hence, the present concepts include novel improvements which enable the entire drawworks to be inspected and repaired as may be necessary to avoid malfunctions. The task of inspecting and repairing a drawworks has been uniquely facilitated by the improvements represented by the instant disclosed novel drawworks.

Accordingly, a primary object of the present invention is the provision of a drawworks having improved safety features that achieve the before mentioned desirable attributes and enables a drilling rig to operate more efficiently and safely.

Another object of the present invention is the provision of a new combination of parts assembled in an unobvious manner to present a new drawworks of improved safety and design.

Another object of the present invention is the provision of an improved drawworks that rapidly can be repaired or retrofited with new components in a minimum of time.

A still further object of this invention is the provision of an improved, rigid main frame for a drawworks that resists deformation when placed under heavy loads.

Another and still further object of this invention is the provision of an improved drawworks having a power train built up of chains and sprockets that have flingers arranged therein for improved distribution of lubricant.

Another and still further object of this invention is the provision of a drawworks having improvements in the drum brake assembly by which close control is effected when weight on bit becomes critical to a drilling operation.

These and other objects of this disclosure will become evident as the remainder of this disclosure is fully digested.

BRIEF DESCRIPTION OF THE SEVERAL VIEWS OF THE DRAWINGS

FIG. 13 is a perspective detailed rear view of part of the gear train of FIG. 9;

FIG. 14 is a perspective detailed view of part of the drawworks of FIG. 10;

FIG. 15 is a perspective ¾ rear view of FIG. 13; and,

FIG. 16 is a perspective rear view of the drawworks of this disclosure.

DETAILED DESCRIPTION OF THE DRAWINGS

Figure 1:
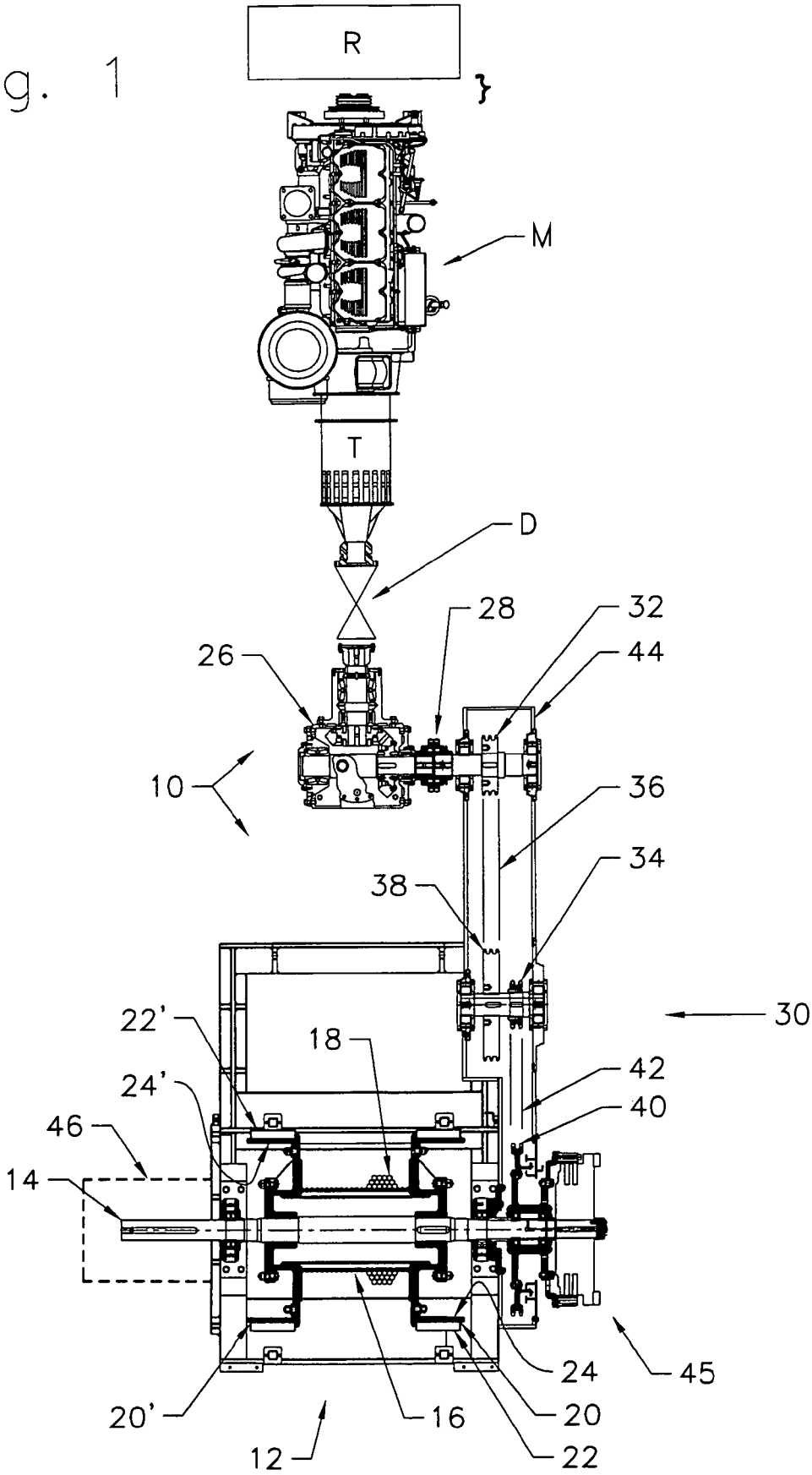
FIG. 1 of the drawing is a part schematical, part diagrammatical plan view representative of part of one embodiment of a drawworks made in accordance with the present invention.

FIG. 1 of the drawings diagrammatically illustrates a drawworks made in accordance with the present invention, wherein there is seen a motor M, radiator R, and transmission T connected by drive line D that forms the prime mover for the drawworks 10 of this disclosure. The drawworks 10 includes cable drum apparatus 12 affixed to drum shaft 14. The drum shaft 14 has the illustrated drum surface 16 for receiving and paying out wire rope or cable 18.

A drum brake assembly 20, 20' is affixed to the cable drum which in turn is affixed to drum shaft 14 and rotates therewith. The drum brake assembly 20, 20' circumferentially extends about brake drum 24 for arresting rotation of the drum when the brake band is forced into high friction engagement respective the drum as will be more fully pointed out herein.

A 90 degree gear box 26 is connected to coupling 28 which drives gear 32 which is spaced from gear 34 which is interconnected by an endless chain 36. Gears 34, 38 are affixed to the illustrated common shaft so that gear 38 drives gear 40 by means of an endless chain 42. Gear 40 is indirectly connected to drum shaft 14 by means of a clutch apparatus (not shown) for rotating cable drum apparatus 12 upon engagement of the clutch.

In FIG. 1, those skilled in the art will appreciate that the motor driven 90 degree gear box 26 is detachably mounted at 28 to the shaft of the 32-tooth sprocket 32 which is aligned with and spaced from the illustrated 62-tooth sprocket 34 mounted on a shaft in axially aligned relationship respective to the 21-tooth sprocket 38.

Figure 2:
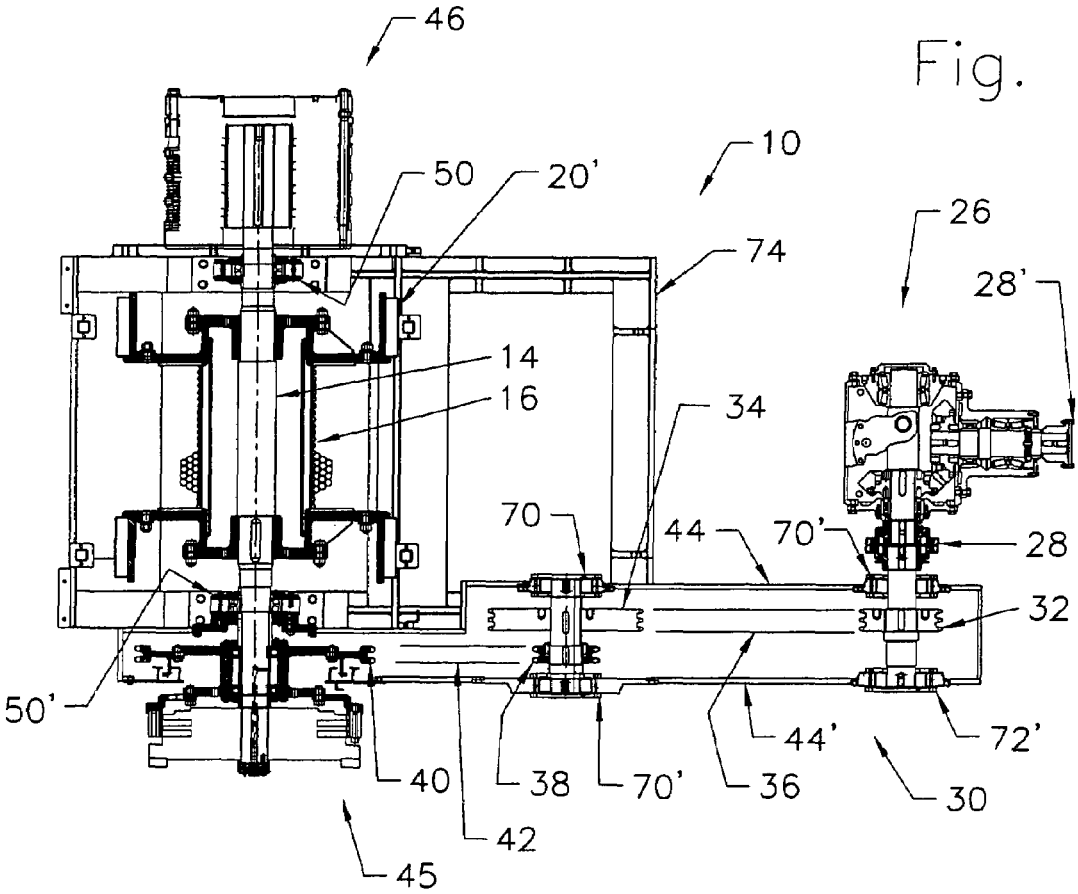
FIG. 2 is a more detailed top plan view that is a part schematical part diagrammatical representation of the apparatus of FIG. 1, with the various parts thereof being numbered and identified later on herein.

The 21-tooth sprocket drives the illustrated 80-tooth sprocket 40, which is removably attached to the drum shaft 14, whereupon each revolution of the 80-tooth sprocket 40 can directly drive the cable drum upon engaging the twin disk clutch assembly 44. Endless chains 36, 42 engage the drive and driven sprockets as indicted in the drawings as particularly shown in FIGS. 1 and 2. As seen in FIG. 2, the 32-tooth sprocket number 32 drives the 62-tooth sprocket 34 with there being three rows of claim illustrated by the dash line in FIGS. 1 and 2. The 62-tooth sprocket 34 is axially aligned respective its jack shaft which chain drives the double row sprocket 38.

Figure 3:
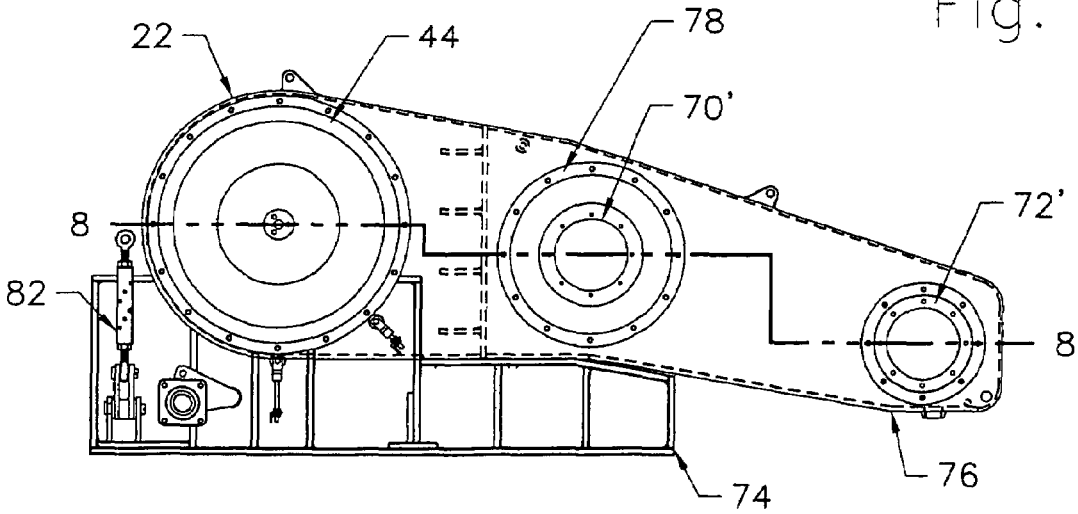
FIG. 3 is a part diagrammatical, part schematical representation of a side view of FIG. 2.
Figure 4:
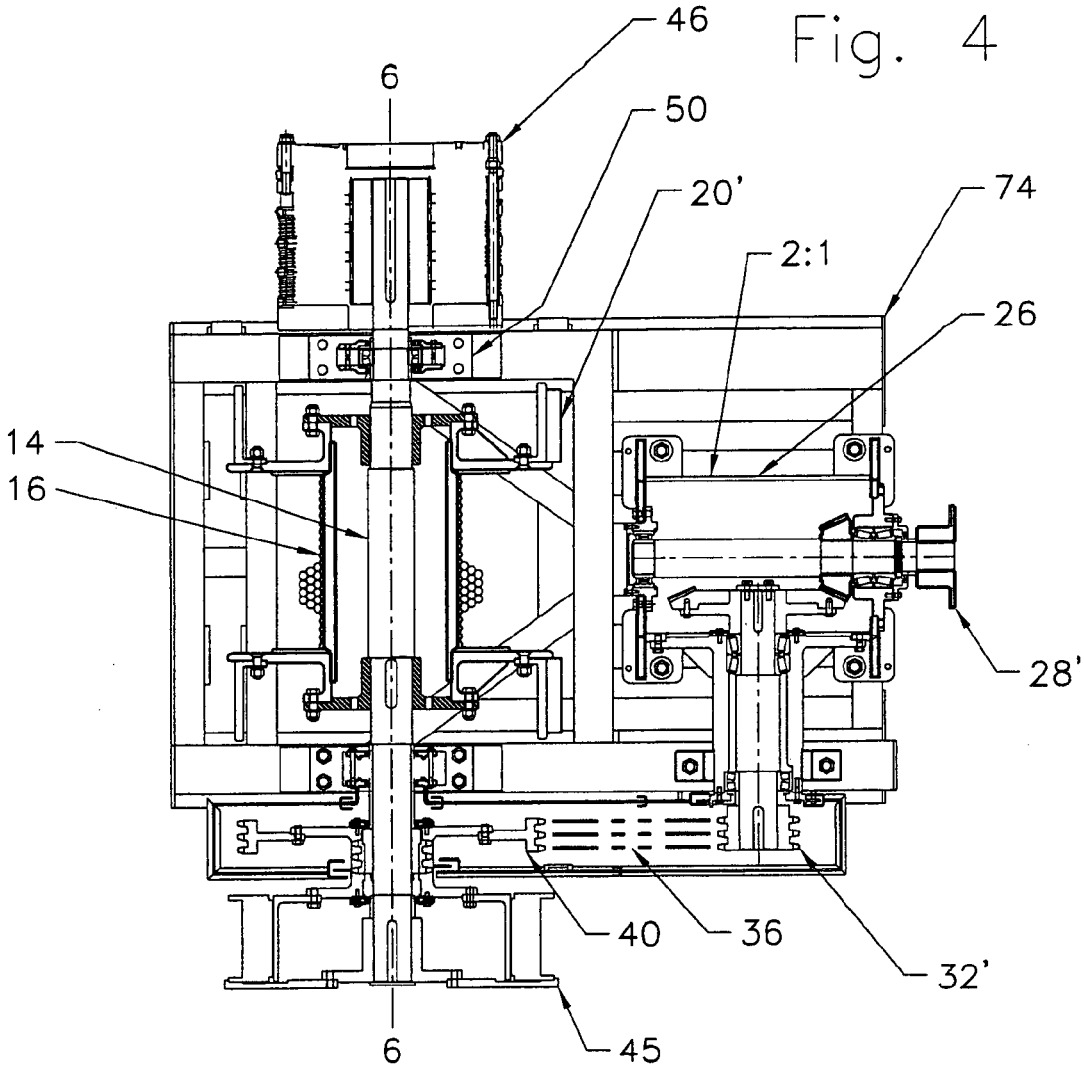
FIGS. 4 and 5 are part diagrammatical, part schematical representation showing an alternate embodiment of the drawworks seen disclosed in FIGS. 2 and 3.
Figure 5:
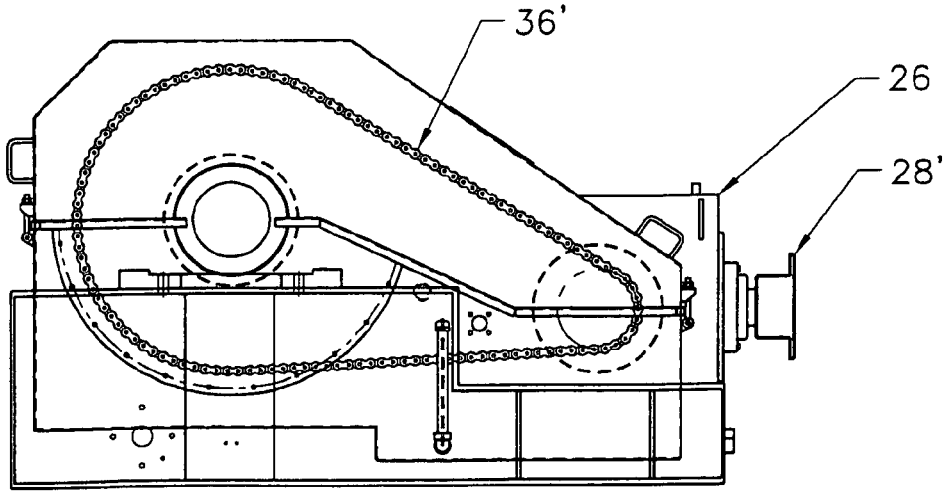
Figure 6:
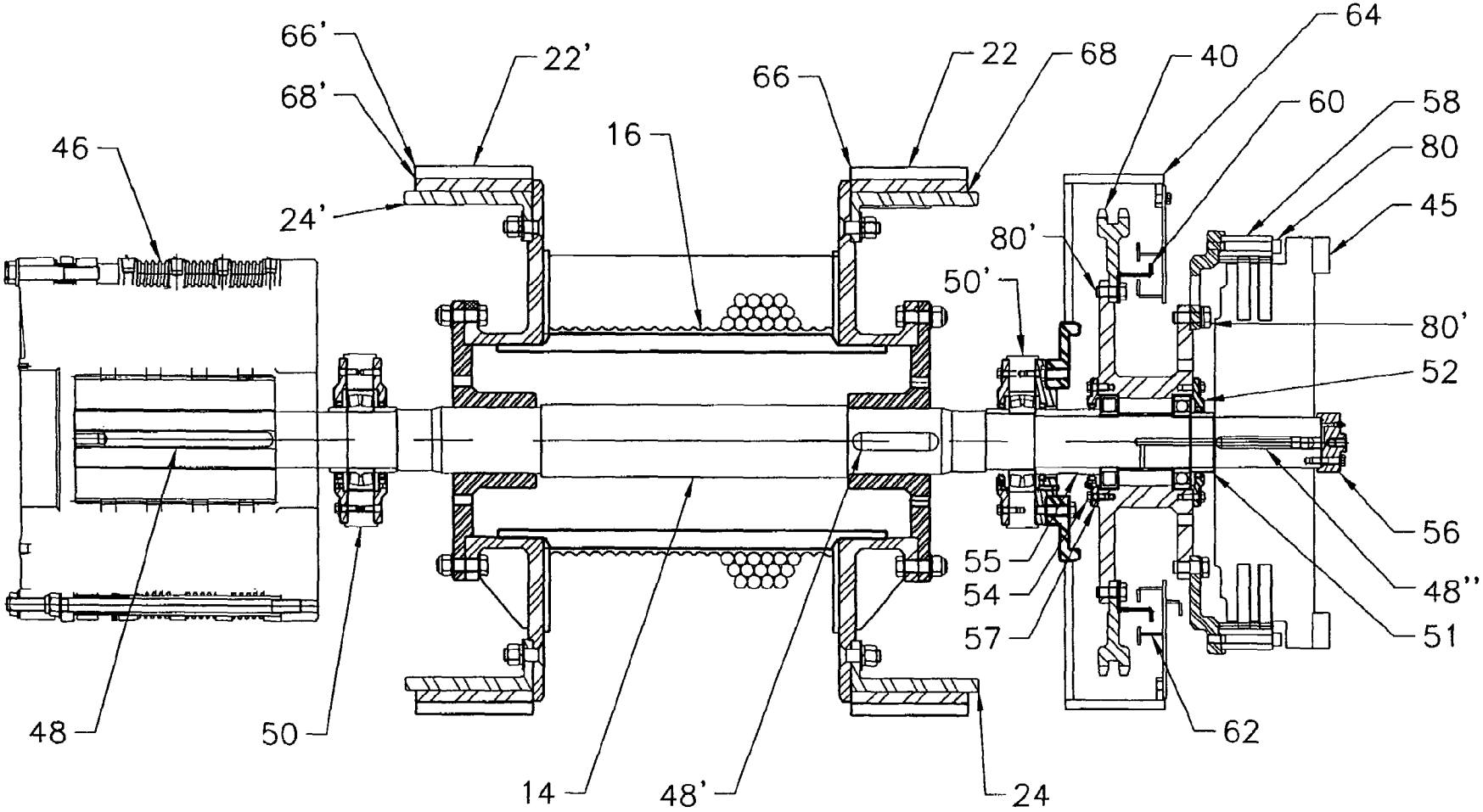
FIG. 6 is an enlarged diagrammatical, part cross sectional view taken along line 6-6 of FIG. 4.
Figure 7:
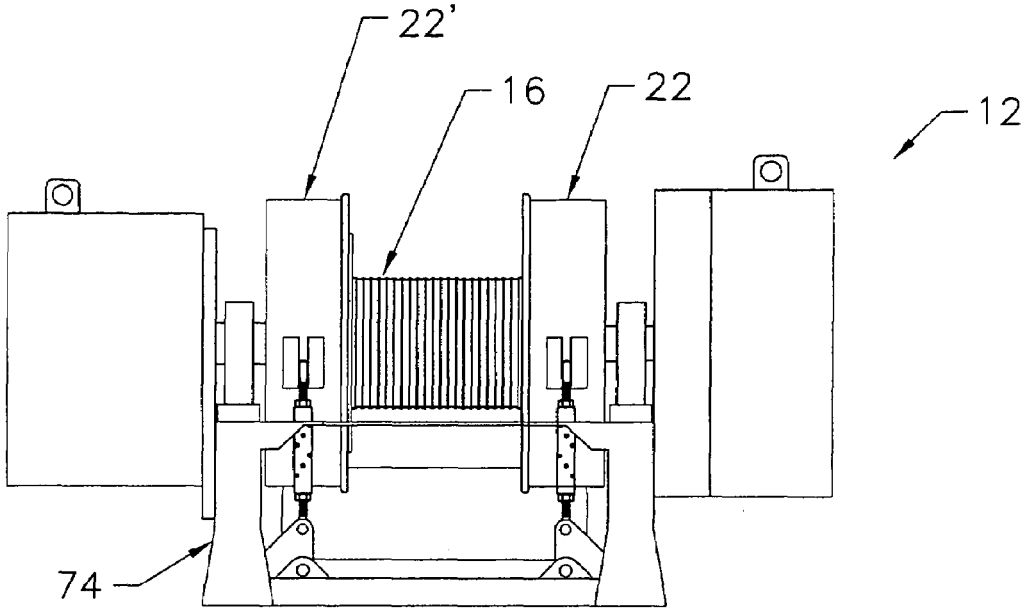
FIG. 7 is a perspective front view of the drawworks of this disclosure.
Figure 8:
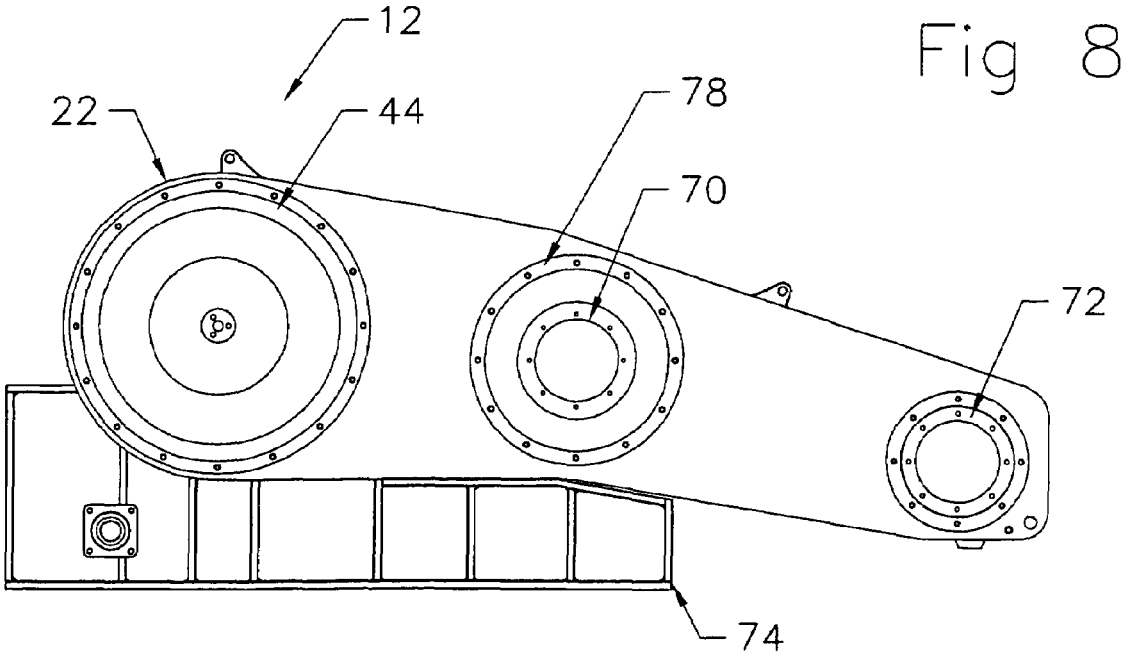
FIG. 8 is a perspective side view of the drawworks of FIG. 7.
Figure 9:
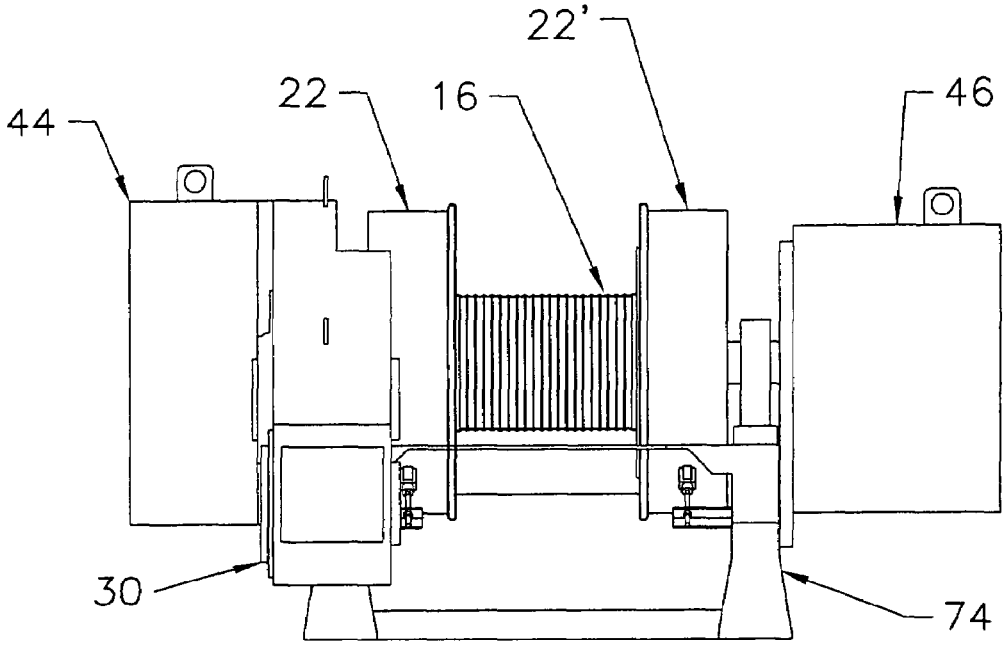
FIG. 9 is a perspective rear view of the drawworks disclosed herein.
Figure 10:
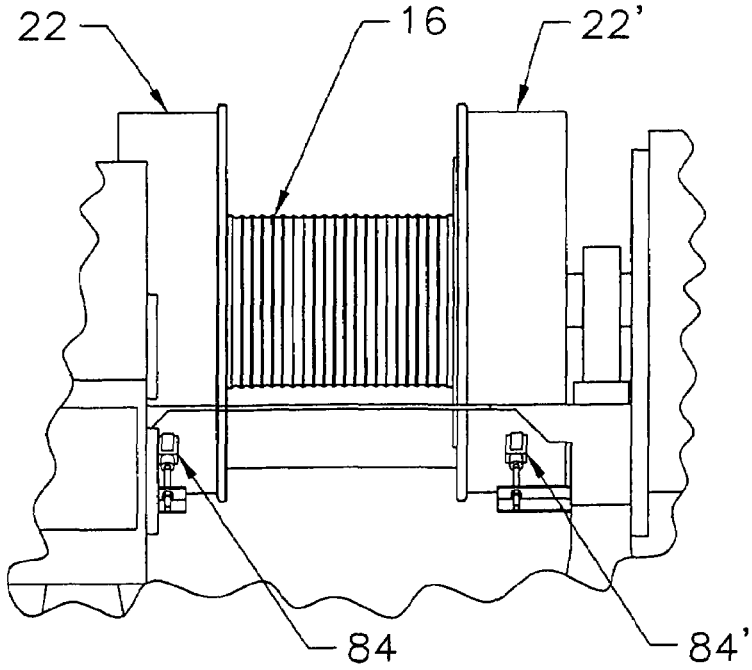
FIG. 10 is an enlarged detailed view of part of FIG. 9.
Figure 11:
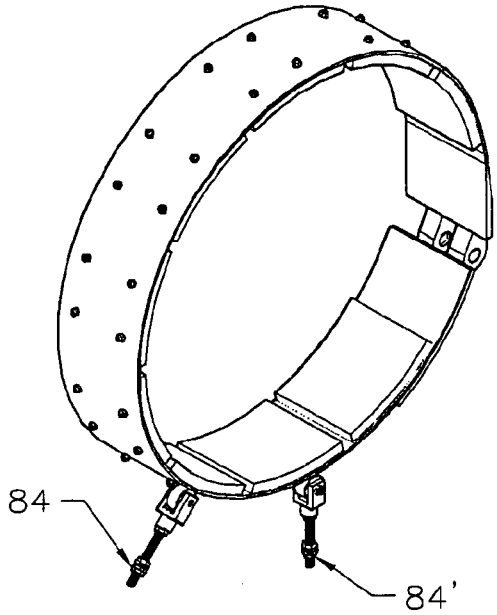
FIG. 11 is an enlarged detailed perspective view of a brake equalizer of FIG. 10.
Figure 12:
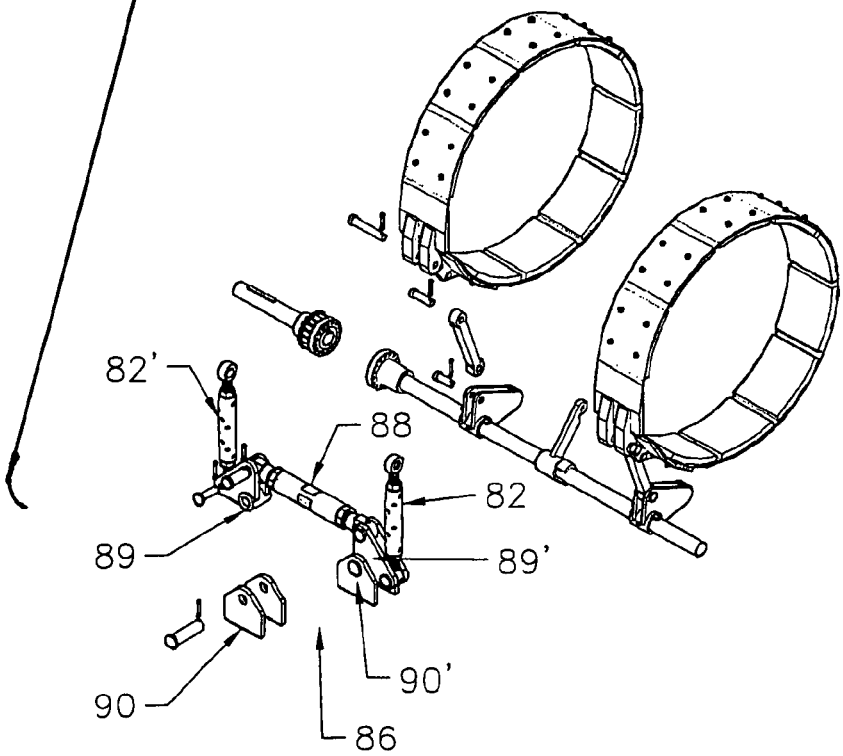
FIG. 12 is a further enlarged detailed perspective view of FIG. 11.

Sprocket 38 is a double row chain drive for driven sprocket 40, which is an 80 tooth sprocket directly attached to the drum shaft 14, as seen in the schematical representation provided by FIGS. 1-3.

Those skilled in the art will appreciate that the massive chassis or framework 74 supports drum 16 along with the other illustrated attachments by means of the spaced bearing assemblies 50 and 50'.

Spaced from the bearing housing 50' located on the right side of the drum is an adaptor plate that remains stationary thereby enabling the chain case to be suitably mounted and which extends into removably attached relationship respective a flinger box 64.

The live hub that supports gear 40 is bolted to an adapter plate that serves as a clutch drive ring. A twin disc clutch 45, when actuated, directly connects the 82-tooth sprocket 40 to drive drum shaft 14.

The drawworks drum is rotationally mounted respective the special built up steel chassis that can withstand the torsional loads exerted when complying with the needs of the drilling operation so that all extraneous loads imposed thereon fail to deform the various coacting bearings and housings. As seen in the various sheets of drawings, every moving part of the improved drawworks is readily accessible for inspection, thereby enabling any cause of malfunction to be obviated to avoid unexpected shut-down.

Of equal importance is the arrangement of all the parts that are subject to wear in a manner enabling the entire component or sub-assembly to be removed, and immediately replaced with a new or overhauled component.

It will be noted that the rearwardly depending extension of the drive train and enclosure therefor downwardly slopes to form a lower storage container for holding lubrication oil. Thus, lub oil gravitates towards the illustrated lub chamber where the flingers engage and transfer the lub oil throughout the interior of the power train for proper lubrication of the working parts within the illustrated enclosure, including the lubrication of all the necessary chain driven components which is enhanced and receive ample lubrication by this arrangement.

The improved concentricity of the brake bands respective the brake drums provide exceptional control to be employed by the novel equalizer brake assembly, which is extremely important for controlling the weight on bit and is very important for positive controlled stopping of the traveling block.

other novel aspect of the instant disclosure is found in the alignment of the massive brake bands previously mentioned. It will be noted that radially disposed rollers bear against the brake actuating band to improve the concentricity of the various parts thereof. An additional novel feature found in the brake and drum system is the before mentioned equalizer arrangement which maintains equal force during brake engagement and while slowing a traveling drill string into a wellbore as well as the necessity of exact rate of lowering of the drill bit to achieve the desired rate of penetration which also is required to achieve the desired weight on bit. The illustrated turnbuckle allows manual fine-tuning of this feature of the invention.

CATALOG OF PARTS

10 drawworks
12 cable drum apparatus
14 drum shaft
16 drum surface
18 wire rope or cable
20' drum brake assembly
22' brake band
24 brake drum
26 90 degree gear box
28 coupling [26 to 32]
30 gear train drum shaft 14
32 input sprocket
33 input sprocket shaft
34 intermediate gear shaft
36 endless chain
38 sprocket attached to 34
40 cable drum drive gear connects to shaft 14 by clutch 45
42 endless chain
44 housing
45 clutch
46 water cooled auxiliary brake
48 key way
50-50' bearing support
52 bearing for gear 40
54 bearing for gear 40
56 fluid swivel for clutch
58 clutch plate mont
60 flinger
62 finger annulua
64 enclosure
66 brake band
68 brake band lining
70 bearings and supports
72' bearings and supports
74 main frame
76 trailing frame
78 cover plate
80 fastener

82 manual brake assembly
84 alignment rollers
86 equalizer
88 turn-buckle
89 crank
90 anchor

I claim:

1. A drawworks for a drilling rig comprising, a main frame, a cable drum affixed to a drum shaft, said drum shaft being rotatably supported respective said main frame, First and second drum brake assemblies having brake drums affixed to and spaced apart by said cable drum and axially aligned respective one another, a prime mover, a drive train, a clutch device interconnecting said prime mover respective said cable drum shaft, each said brake assembly includes a brake band having ends, one said brake band circumferentially extending about one said brake drum, one end of said brake band being affixed to the main frame with the remaining end thereof connected to a brake equalizer apparatus that equalizes the braking forces applied to each said brake assembly;

said brake equalizer includes apparatus for moving the brake bands relative the brake drums; and further including a plurality of low friction alignment rollers radially extending toward said drum shaft to engage and position the brake bands closely adjacent the brake drums and thereby arrange said brake bands into concentric alignment respective the brake drums; and linkage including bell-cranks for applying equally divided force between each said brake band and brake drum therefore.

2. The drawworks of claim 1 wherein said drive train comprising a plurality of spaced shafts arranged within a housing in parallel relationship respective one another; chain drive sprockets mounted on said spaced shafts; an endless chain between said drive sprockets connected to rotate said drum shaft in response to being rotated by a prime mover.

3. The drawworks of claim 2, wherein there is further included an auxiliary brake apparatus for increasing friction between said cable drum shaft and said cable drum upon demand.

4. A drawworks for a drilling rig comprising a main frame, a cable drum affixed to a drum shaft, bearing means by which said drum shaft is rotatably supported respective said main frame;

first and second brake drums axially aligned respective one another and affixed to said drum shaft to thereby rotate concurrently with said drum shaft;

a prime mover, a clutch device, a drive train interconnecting said prime mover respective said drum shaft by means of said clutch device;

a brake assembly for concurrently engaging each said first and second brake drums; each said brake assembly includes a discontinuous brake band extending circumferentially about each brake drum and having ends, with one end fixed respective said main frame and with the other end thereof being affixed to a brake equalizer apparatus by which the brake bands of the brake assemblies are equally tensioned and thereby equally applied to the brake drums to controllably arrest rotation of the cable drum;

said brake equalizer including a tensioning device including a turnbuckle having ends connected to increase brake band tension when the turnbuckle is adjusted in one rotational direction and to decrease brake band tension when adjusted in an opposite direction; and, a plurality of low friction alignment rollers radially arranged about each brake band and adjustably forcing the brake band into concentric relationship respective the brake drum, whereby, a maximum braking contact surface is realized upon engagement between the brake drum and brake band apparatus as a result of the coacting surfaces thereof being positioned for maximum engagement there between.

5. The apparatus of claim 4, wherein said power train is located within a trailing housing having a forward end attached to said main frame and connected for rotating the drum shaft; said trailing housing being positioned respective to said main frame to downwardly slope towards the prime mover to thereby provide an oil accumulator system within the interior of the trialing housing; and wherein, said power train has a sprocket connected to an input shaft and provided with radial flingers disposed within the housing lubrication accumulator for flinging oil within the trailing housing.

6. The apparatus of claim 5 and further including a clutch between the drum shaft and the brake drum, a fluid actuated brake arranged between said drum shaft and said brake drum for engagement thereof when heavy loads are imposed on said cable drum.

* * * * *